US006717561B1

(12) United States Patent
Pfeiffer et al.

(10) Patent No.: US 6,717,561 B1
(45) Date of Patent: Apr. 6, 2004

(54) DRIVING A LIQUID CRYSTAL DISPLAY

(75) Inventors: Matthias Pfeiffer, Mesa, AZ (US); Russell Flack, Scottsdale, AZ (US); Anna Prakash, Mesa, AZ (US)

(73) Assignee: Three-Five Systems, Inc., Tempe, AZ (US)

( * ) Notice: Subject to any disclaimer, the term of this patent is extended or adjusted under 35 U.S.C. 154(b) by 0 days.

(21) Appl. No.: 09/774,984

(22) Filed: Jan. 31, 2001

Related U.S. Application Data

(63) Continuation-in-part of application No. PCT/US00/25583, filed on Sep. 18, 2000.
(60) Provisional application No. 60/179,210, filed on Jan. 31, 2000.

(51) Int. Cl.[7] ..... G09G 3/36
(52) U.S. Cl. ..... 345/87; 345/94; 345/95; 345/208; 345/210
(58) Field of Search ..... 345/87, 94, 95, 345/208, 210, 89

(56) References Cited

U.S. PATENT DOCUMENTS 5,644,330 A 7/1997 Catchpole et al. ..... 345/95
5,748,277 A * 5/1998 Huang ..... 349/169
5,889,566 A * 3/1999 Wu et al. ..... 349/35
5,933,203 A * 8/1999 Wu et al. ..... 349/35
6,133,895 A * 10/2000 Huang ..... 345/94
6,204,835 B1 * 3/2001 Yang et al. ..... 345/94
6,268,840 B1 * 7/2001 Huang ..... 345/94
6,278,429 B1 * 8/2001 Ruth et al. ..... 345/94
6,317,111 B1 * 11/2001 Nito et al. ..... 345/88
6,519,013 B1 * 2/2003 Nagai et al. ..... 349/33

* cited by examiner

*Primary Examiner*—Richard Hjerpe
*Assistant Examiner*—Kimnhung Nguyen
(74) *Attorney, Agent, or Firm*—Baker Botts L.L.P.

(57) ABSTRACT

The present invention includes methods and apparatus for driving a cholesteric display system using a dynamic drive scheme. The dynamic drive scheme is used to drive the electrodes of the cholesteric display in order to provide desired pixel states. Pixel states are controlled by the voltage applied across the pixel. The present invention uses pulse width modulation (PWM) during the dynamic drive scheme in order to control the voltage applied across the pixels. PWM modulation may be used during any phase (e.g., preparation phase, selection phase, evolution phase, and/or final phase) of the dynamic drive waveform depending on the needs of the cholesteric display system.

7 Claims, 7 Drawing Sheets

DRIVING A LIQUID CRYSTAL DISPLAY

RELATED APPLICATIONS

This patent application claims priority to, and the benefit of, the provisional patent application entitled "METHOD AND APPARATUS FOR DRIVING A DISPLAY" filed on Jan. 31, 2000 as Serial No. 60/179,210, the entire content of which is hereby incorporated by reference. This patent application is also a Continuation-In-Part application of Patent Cooperation Treaty application entitled "METHOD AND APPARATUS FOR DRIVING A CHOLESTERIC DISPLAY" filed on Sep. 18, 2000 as PCT/US00/25583, the entire content of which is hereby incorporated by reference.

FIELD OF THE INVENTION

The present invention generally relates to display (LCD) systems, and more particularly, to drive schemes for display systems.

BACKGROUND OF THE INVENTION

Displays are commonly used to convey information in a variety of fields. Computers, signs, telephones, televisions, kitchen appliances, vehicle cockpits and innumerable other devices use electronic displays. Various applications require different kinds of displays, and display technology continuously advances to satisfy needs and improve performance of displays in old and new applications alike.

For example, bistable displays, such as cholesteric displays, operate in many environments and applications. Bistable pixels typically exhibit at least two stable states, one generally reflective and the other generally transmissive, such that the pixel tends to retain the selected state after the voltage across the pixel is removed. By selectively placing the various pixels in one state or another, an image may be formed on the display that is retained when the voltage across the liquid crystal material is removed. In some bistable displays, pixels may have only two states, whereas other displays provide shades of black, white, gray, colors, and the like, depending on the needs of the display system, using areas of dark or bright domains within the pixel.

A drive circuit typically generates the voltages across the pixels to change the display. In many conventional displays, the drive circuit applies signals to a series of row and column electrodes that define a matrix of pixels. The signals are provided according to a selected drive scheme to determine how the signals are applied to the various electrodes to achieve the desired image on the display. A standard drive scheme is illustrated in Catchpole et al., U.S. Pat. No. 5,644,330, issued Jul. 1, 1997, a cumulative drive scheme is illustrated in Huang, U.S. Pat. No. 6,133,895, issued Oct. 17, 2000, and a dynamic drive scheme for cholesteric LCDs is illustrated in Huang et al., U.S. Pat. No. 5,748,277, issued May 5, 1998. In another example, a progressive scanning drive scheme starts signals with a delay for each row electrode with respect to the previous row electrode. In a scanning display, each pixel in a single row is selected or deselected by a segment signal applied to the corresponding column electrode. In this manner, the segment signal may create a pixel level that is either "select" or "non-select", that is, transmissive or reflective. The states of pixels in other rows are essentially not influenced by the segment signals.

Conventional drive schemes for cholesteric displays, however, require complicated drive circuitry. For example, a drive circuit configured to implement a conventional drive scheme may provide a common signal having four different phases (preparation, selection, evolution, and final) and a segment signal that selects the state of the relevant pixel. Each phase of the common signal normally includes two or more voltage levels, and the segment signal normally requires at least two voltage levels. Thus, to implement the common and segment signals, the drive circuit may provide ten or more different voltage levels to the electrodes.

In addition, the appropriate voltage levels to achieve desired pixel states might not remain uniform over time and conditions. For example, the temperature of the liquid crystal material may affect its optical characteristics. To compensate for temperature variations, the signal voltage levels may need to be adjusted as a function of temperature for improved display performance. Such adjustments are typically made by adjusting or tuning one or more of the voltage levels of the common signal, for example. Conventional systems might use one or more variable voltage supplies. Such supplies, however, often add cost, complexity, and power consumption to the drive circuit.

SUMMARY OF THE INVENTION

A display system according to various aspects of the present invention includes methods and apparatus for driving a cholesteric display system using pulse width modulation (PWM) to control the RMS voltage applied across the pixels of the display. By using PWM to control the overall voltage, fewer voltage levels may be used during one or more phases. Further, PWM may affect the RMS voltage applied across the liquid crystal material to compensate for display variations such as optical effects due to temperature changes or to achieve other effects upon the liquid crystal.

BRIEF DESCRIPTION OF THE DRAWING FIGURES

The subject invention will hereinafter be described in the context of the appended drawing figures, wherein like numerals denote like elements, and:

DETAILED DESCRIPTION OF EXEMPLARY EMBODIMENTS

The present invention may be described in terms of functional block components and various processing steps. Such functional blocks may be realized by any number of hardware and/or software components configured to perform the specified functions. For example, the present invention may employ various integrated circuit components, e.g., memory elements, signal processing and generation elements, power supplies, and the like, which may carry out a variety of functions under the control of one or more circuits, processors, or other control devices. In addition, various aspects of the present invention may be practiced in any number of display contexts and the various systems described are merely exemplary applications for various aspects of the invention. Further, a display system in accordance with various aspects of the present invention may employ any number of conventional techniques and components, such as liquid crystal material, power supplies, drive signal generation and control techniques, and the like. Still further, the present invention may be embodied as a method, a display system, a device for driving a display, and/or a computer program product. Furthermore, the methods and apparatus according to various aspects of the present invention may take the form of a computer program product on a computer-readable storage medium having computer-readable program code means embodied in the storage medium.

Figure 1:
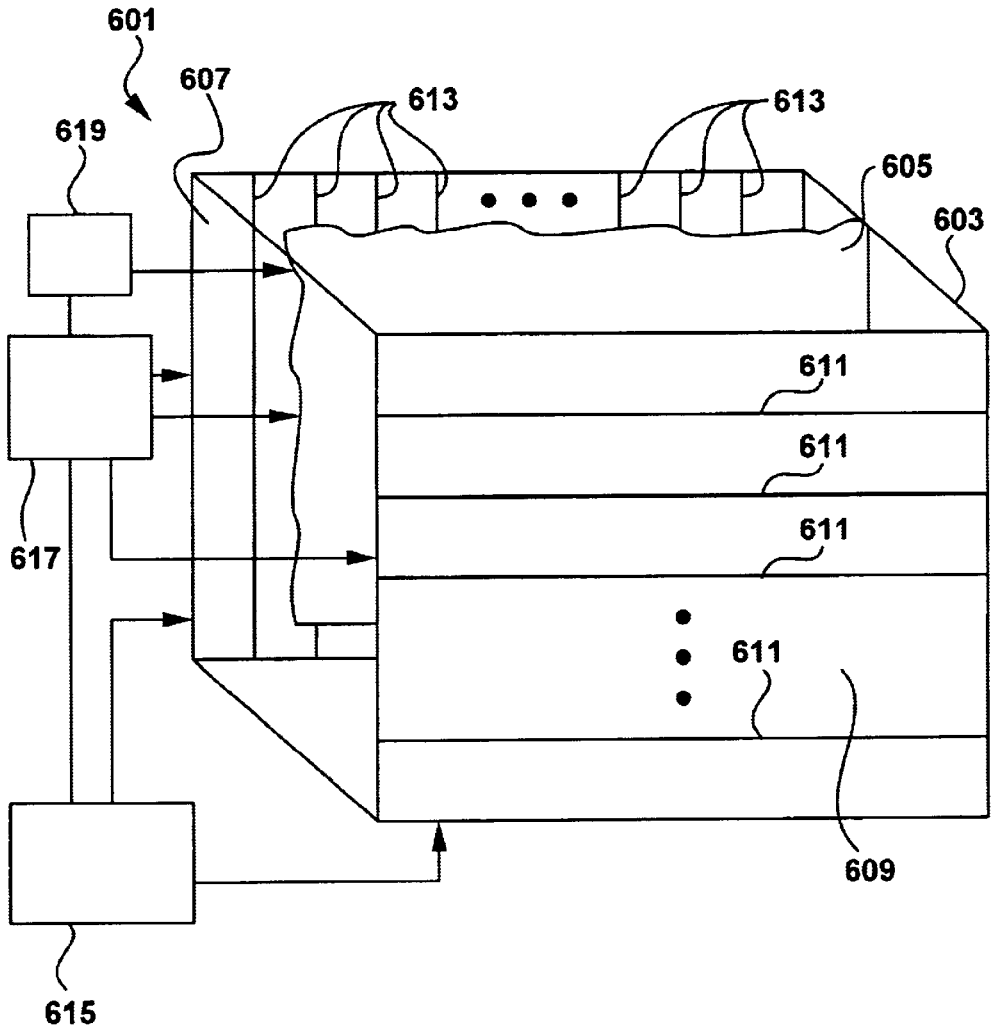
FIG. 1 illustrates a liquid crystal display (LCD) system in accordance with an exemplary embodiment of the present invention.

Referring to FIG. 1, a liquid crystal display (LCD) system 601 in accordance with an exemplary embodiment of the present invention includes a bistable display panel 603 having a liquid crystal layer 605 between two surfaces, such as a substrate 607 and a cover 609. The substrate 607 may include, but is not limited to, glass, plastic, ceramic, or other suitable material, and may be selected according to any suitable criteria, such as transparency, durability, thermal characteristics, and/or the like. Similarly, the cover 609 may be comprised of any suitable material for containing the liquid crystal material and facilitating viewing. For example, suitable materials for the cover include soda lime glass, borosilicate glass (e.g., Schott borofloat 33 or Corning 1737F glass), and/or the like.

A set of row electrodes 611 are coupled to one surface, such as cover layer 609, and a set of column electrodes 613 are coupled to the other surface, such as substrate layer 607, for forming a field across the liquid crystal material. The electrodes suitably form a matrix of pixels to allow addressing and control of individual pixels and/or icons. The electrodes may be formed of any suitable material, such as indium tin oxide (ITO). Further, the electrodes may be configured in any appropriate manner or disposed on any suitable surface. In addition, each electrode may be coated with an aligning layer, such as a conventional aligning layer of polyimide.

In the present embodiment, the liquid crystal material comprises a bistable liquid crystal material, such as a surface or polymer stabilized cholesteric liquid crystal material. A suitable bistable material may have two stable states (reflective planar state (bright) and focal conic state (dark)) and two non-stable/intermediate states (homeotropic state and transient planar state). The display system suitably employs a bistable chiral nematic liquid crystal (e.g., cholesteric) or any appropriate liquid crystal material, such as twisted nematic, super twisted nematic, ferroelectric, or other suitable liquid crystal materials. Any criteria may be used to select the liquid crystal, such as to substantially optimize various properties of the display system. The thickness of the liquid crystal layer is substantially optimized for selected display characteristics.

LCD system 601 also includes a drive system. The drive system applies voltages to the electrodes in accordance with a drive scheme to change the state of the liquid crystal material. A dynamic drive scheme includes applying common signals to one set of electrodes (e.g., row electrodes) and segment signals to the other set of electrodes (e.g., column electrodes). Common signals may be applied to one or more row electrodes at the same time. Segment signals are applied to the column electrodes to select the desired state of the pixel. The voltage across a pixel is defined by the difference between the common signal (e.g., row electrodes) and the segment signal (e.g., column electrodes). The pixel responds according to the root-mean-square (RMS) voltage difference across the liquid crystal. Generating a voltage across a pixel may activate, change the appearance, or otherwise modify the pixel depending on the needs of the display system. For example, in a binary display, the pixel is either dark (e.g., black) or bright (e.g., white).

In the present embodiment, the drive system includes a source 615 coupled to row and column electrodes 611, 613 for providing a selected RMS voltage across one or more pixels of cholesteric display panel 603 via row electrodes 611 and/or column electrodes 613. A controller 617 is coupled to cholesteric display panel 603 and source 615 for facilitating adjustment of the root-mean-square voltage across the one or more pixels, for example using pulse width modulation (PWM). The controller 617 and source 615 may be implemented as separate components or integrated into a single device.

In addition, a sensor 619 may be coupled between cholesteric display panel 603 and controller 617 in order to feedback desired parameters to controller 617. For example, sensor 619 may include a temperature sensor (e.g., thermistor, diode, and/or the like) for sensing the temperature of the liquid crystal material and translating the temperature into a voltage (e.g., an RMS voltage). As such, if adjustment of the RMS voltage is desired due to the warming up of cholesteric display panel 603, the drive system may compensate for optical effects by adjusting the RMS voltage based on the measured temperature from sensor 619. In this manner, sensor 619 may communicate with controller 617 in order to choose the amount of PWM depending on the reading (e.g., temperature reading) of sensor 619.

Figure 2:
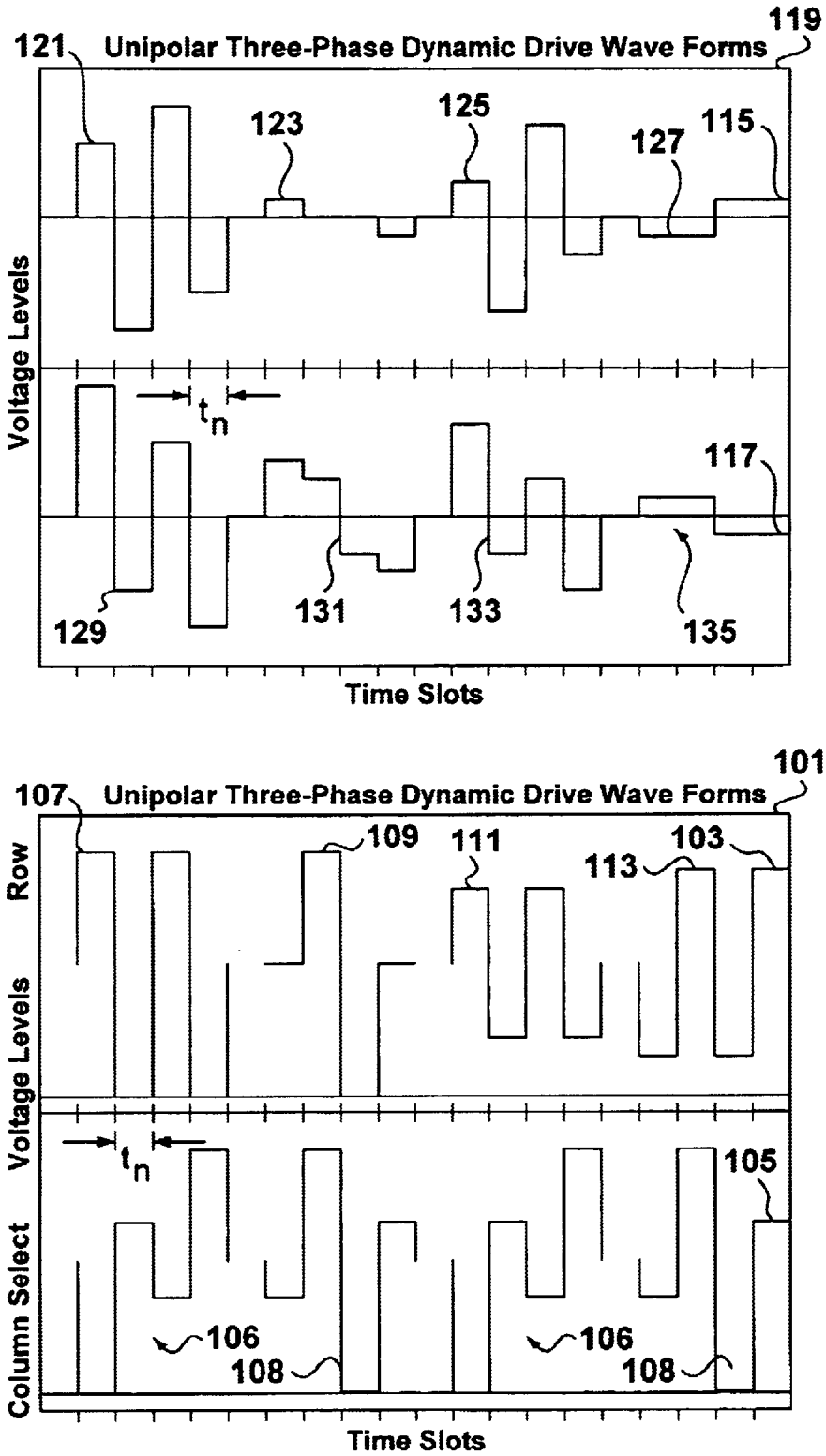
FIG. 2 illustrates a drive scheme for a cholesteric display in accordance with an exemplary embodiment of the present invention.

The drive scheme used by the drive system determines the signals applied to the electrodes to generate the desired RMS voltages across the liquid crystal. Referring to FIG. 2, a drive scheme 101 for a cholesteric display in accordance with an exemplary embodiment of the present invention suitably includes a first waveform for one set of electrodes and a second waveform for another set of electrodes. Drive scheme 101 may also be a standard drive scheme, a cumulative drive scheme, or any other suitable drive scheme. The drive scheme suitably comprises a unipolar implementation of a dynamic drive scheme as described in provisional patent application entitled "METHOD AND APPARATUS FOR DRIVING A CHOLESTERIC DISPLAY" filed on Sep. 17, 1999 as U.S. Serial No. 60/154,412 and Patent Cooperation Treaty application entitled "METHOD AND APPARATUS FOR DRIVING A CHOLESTERIC DISPLAY" filed on Sep. 18, 2000 as PCT/US00/25583, the entire contents of which are hereby incorporated by reference.

In accordance with the dynamic drive scheme 101, a common signal waveform 103 (e.g., one or more common signals) drives a set of row electrodes of the display, and a segment signal waveform 105 (e.g., one or more segment signals) drives a set of column electrodes of the display. Common signal waveform 103 suitably includes one or more phases e.g., preparation phase 107, selection phase 109, evolution phase 111, and/or final phase 113.

In the preparation phase, for example, pixels switch to a well-defined homeotropic state, regardless of each pixel's prior state. Usually, a high voltage (e.g., about 20 to 50 Volts) is applied to the electrodes during the preparation phase. In the selection phase, voltage levels are applied to the electrodes to either maintain the pixels in the homeotropic state or bring the pixels to the transient planar state and maintain the pixels in this state. For example, one voltage level may be high enough to maintain the pixels in the homeotropic state without allowing the pixels to go into another state. Another voltage level may be low enough to allow a transition into the transient planar state and maintain the pixels in the transient planar state without allowing the pixels to shift to the reflective planar state. Specific "high" and "low" voltages may be selected according to any appropriate criteria, such as the particular liquid crystal material being used. The selection phase determines the final state of the pixel based on the voltage levels applied to the electrodes. In this manner, control of the pixel states is based on the RMS voltage levels applied during the selection phase. As such, control of the voltage levels during the selection phase is achieved by selection of the appropriate unit pulse for the segment signal.

In the evolution phase, different RMS voltage levels are applied to maintain the homeotropic state if the pixels are in the homeotropic state, or to shift the pixels from the transient planar state to the focal conic state if in the transient planar state. Finally, in the final phase, if the pixel is in the focal conic state, then the pixel remains in that state. If the pixel is in the homeotropic state, then the pixel shifts from the homeotropic state through the transient planar state to the reflective planar state. Alternatively, instead of using the final phase, the signals may simply be turned off (e.g., via terminating the available voltage).

When the difference between the voltage levels of the row and column electrodes during the selection phase for dynamic drive waveform is relatively low, then the resulting pixel state is focal conic (dark). On the other hand, when the difference between the voltage levels of the row and column electrodes during the selection phase for dynamic drive waveform is relatively high, then the resulting pixel state is reflective planar (bright).

In the present embodiment, each of preparation phase 107, selection phase 109, evolution phase 111, and/or final phase 113 of the common signal represents a unit pulse having multiple time slots, such as four slots in the present embodiment, where each time slot has a duration of time $t_n$. Each unit pulse may have any desired number of time slots and voltage levels. In addition, each unit pulse of preparation phase 107, selection phase 109, evolution phase 111, and/or final phase 113 may be repeated any number of times during each respective phase.

Segment signal waveform 105 suitably comprises one of two possible unit pulses, unit pulse 106 and unit pulse 108, to select or de-select the pixel. Segment signal waveform 105 may include any number of unit pulses 106 and/or 108.

The application of common signal waveform 103 to the row electrodes and either a select segment signal or a deselect segment signal to the column electrodes generates desired RMS voltages across the pixels and drives them to their desired states. The resulting voltages across the pixels may be characterized as a select waveform 117 or a deselect waveform 115. Deselect waveform 115 represents the difference between the voltage levels of common signal waveform 103 (e.g., the row electrodes) and segment signal waveform 105 (e.g., the column electrodes) while a deselect segment waveform, comprising repeated unit pulses 108, is applied. Deselect waveform 115 also includes one or more phases, such as phases corresponding to the preparation phase 121, selection phase 123, evolution phase 125, and/or final phase 127 applied by the common signal waveform 103. Likewise, select waveform 117 represents the difference between the voltage levels of common signal waveform 103 and the select segment signal waveform 105, suitably comprising multiple unit pulses 106, and similarly comprises multiple phases.

Referring to FIGS. 3 through 6, an alternative dynamic drive scheme 201 for a cholesteric display uses fewer voltage levels in the common signal and employs pulse width modulation (PWM) to control the RMS voltage applied to the liquid crystal in at least one of the phases. Using PWM for at least one of the common signal or the segment signal aids in adjusting the RMS voltage of the various waveforms 203, 205, 215, and/or 217 to drive the cholesteric display. PWM may be used during at least one of preparation phase 207, selection phase 209, evolution phase 211, and/or final phase 213. In addition, PWM may be used while applying at least one of unit pulse 206 and/or unit pulse 208. Any level between the maximum and minimum voltage levels may be used, and any of the phases (e.g., preparation phase, selection phase, evolution phase, and/or final phase) may be selected during the PWM. Further, the drive scheme may also be implemented using any other drive scheme, e.g., standard drive scheme, cumulative drive scheme, bipolar drive scheme, and/or the like, and the cholesteric display may be any type of display, e.g., surface stabilized, polymer stabilized cholesteric display, and/or the like.

Figure 3:
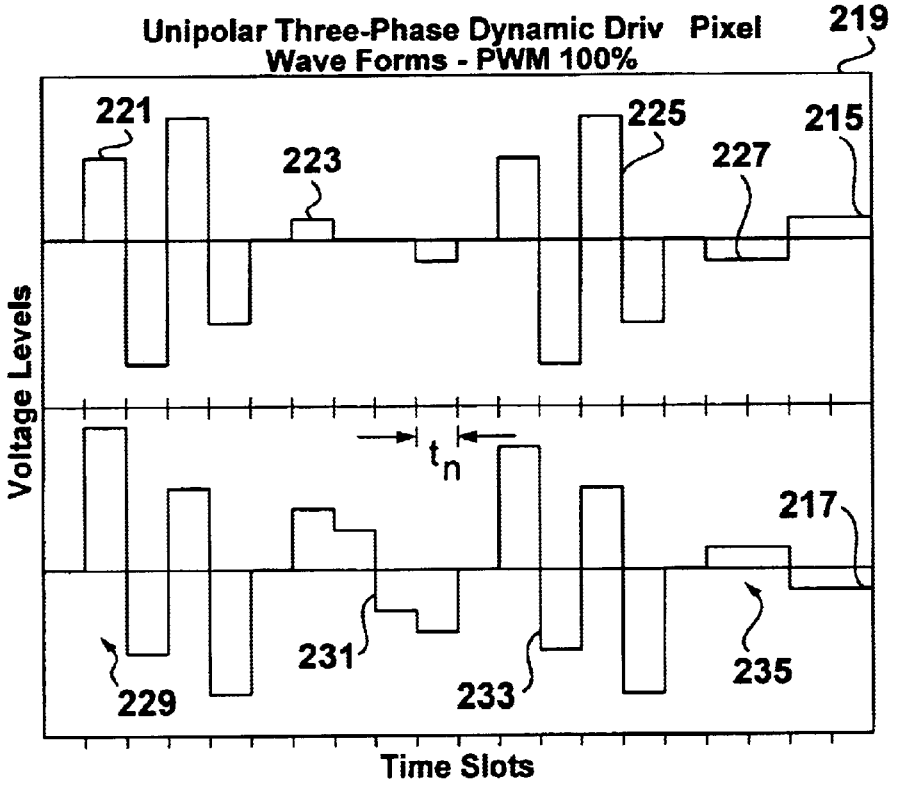
FIG. 3 illustrates a drive scheme for a cholesteric display using 100% Pulse Width Modulation (PWM) in accordance with an exemplary embodiment of the present invention.
Figure 3:
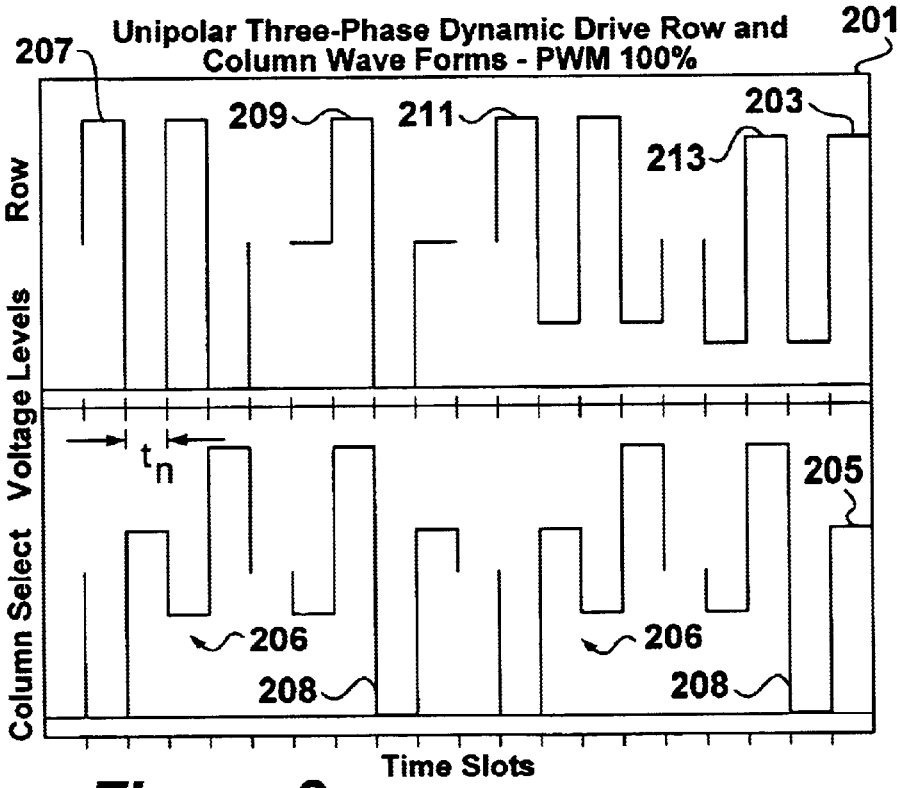
Figure 4:
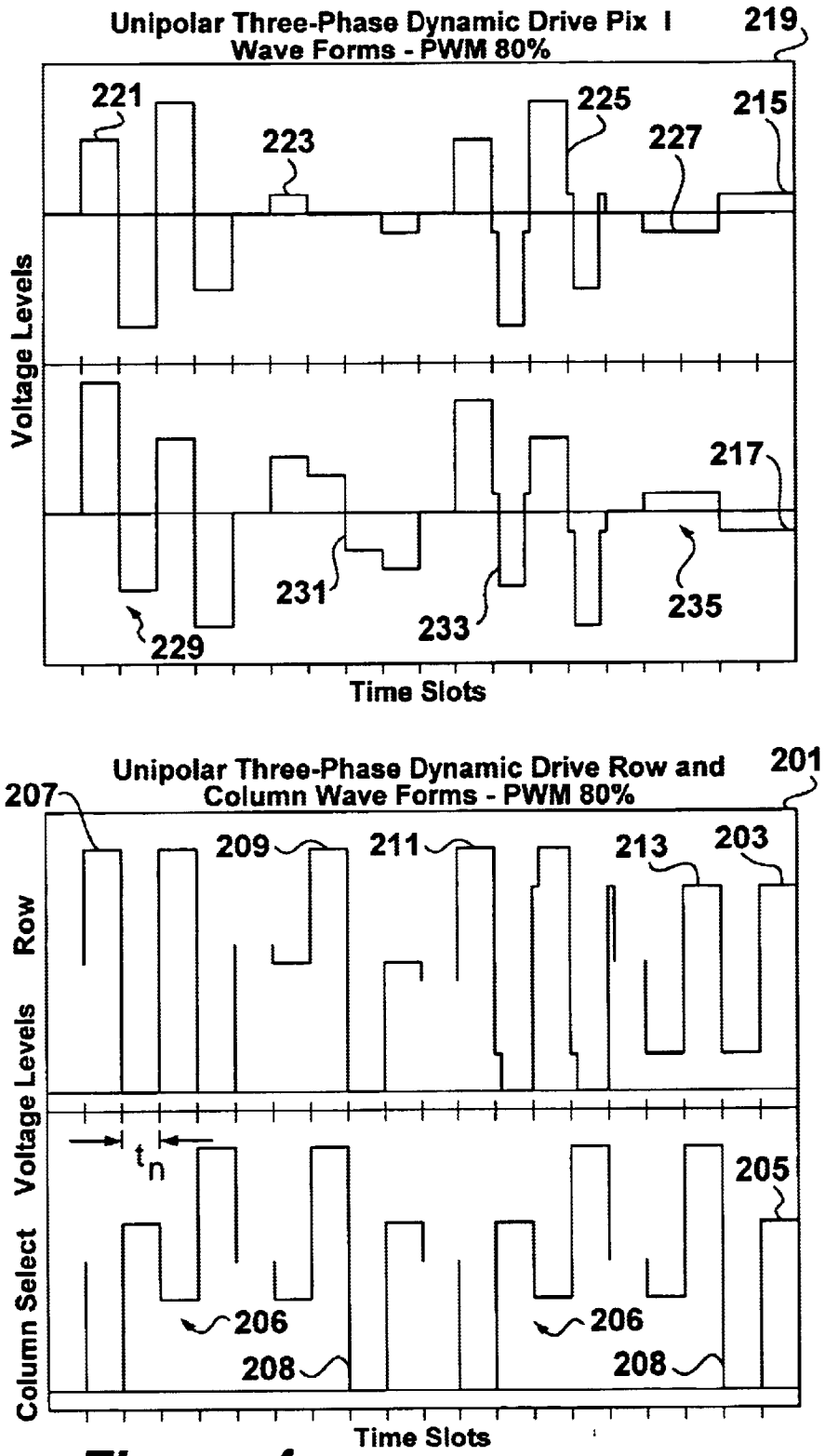
FIG. 4 illustrates a drive scheme for a cholesteric display using 80% PWM in accordance with an exemplary embodiment of the present invention.
Figure 5:
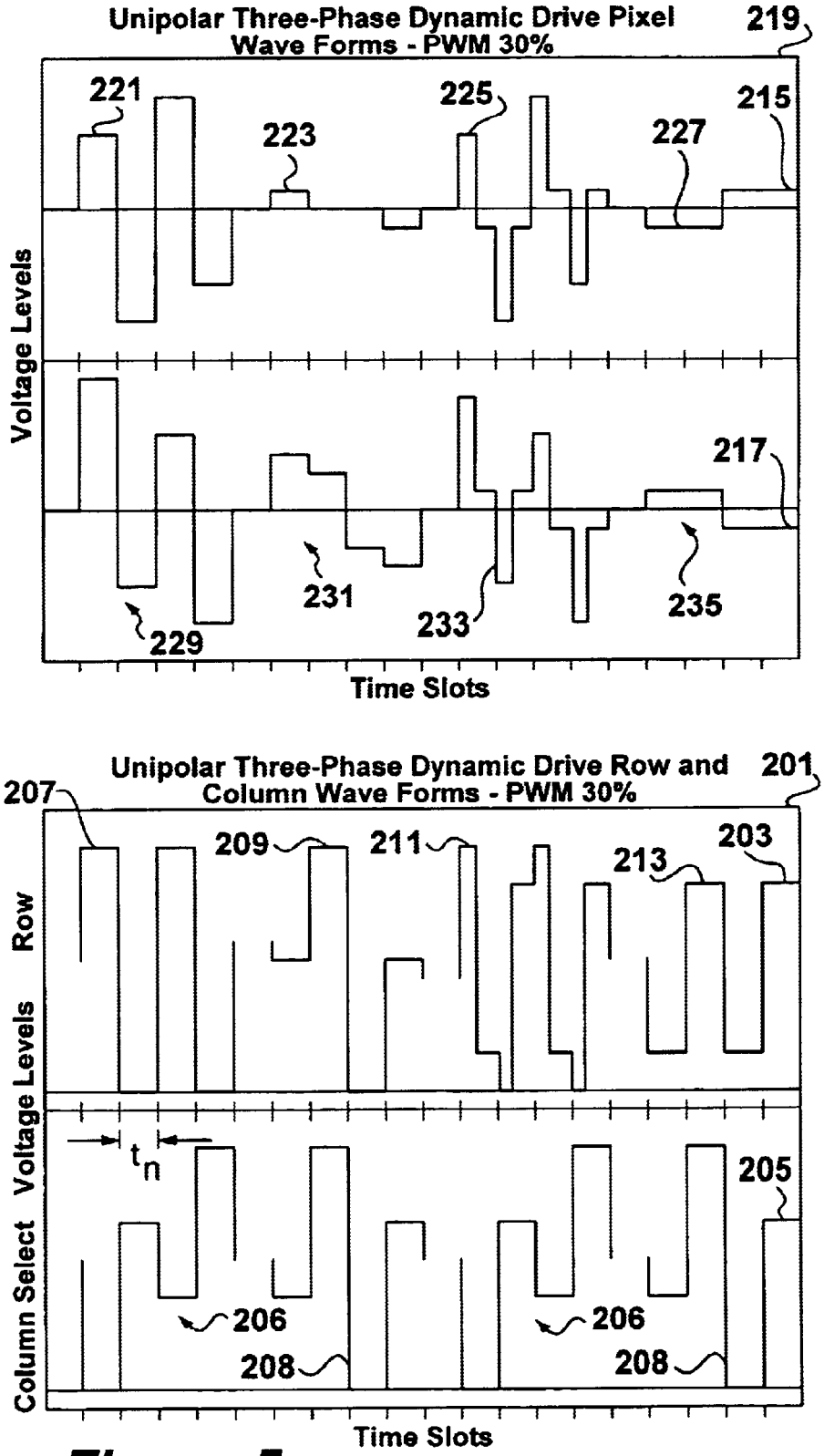
FIG. 5 illustrates a drive scheme for a cholesteric display using 30% PWM in accordance with an exemplary embodiment of the present invention.
Figure 6:
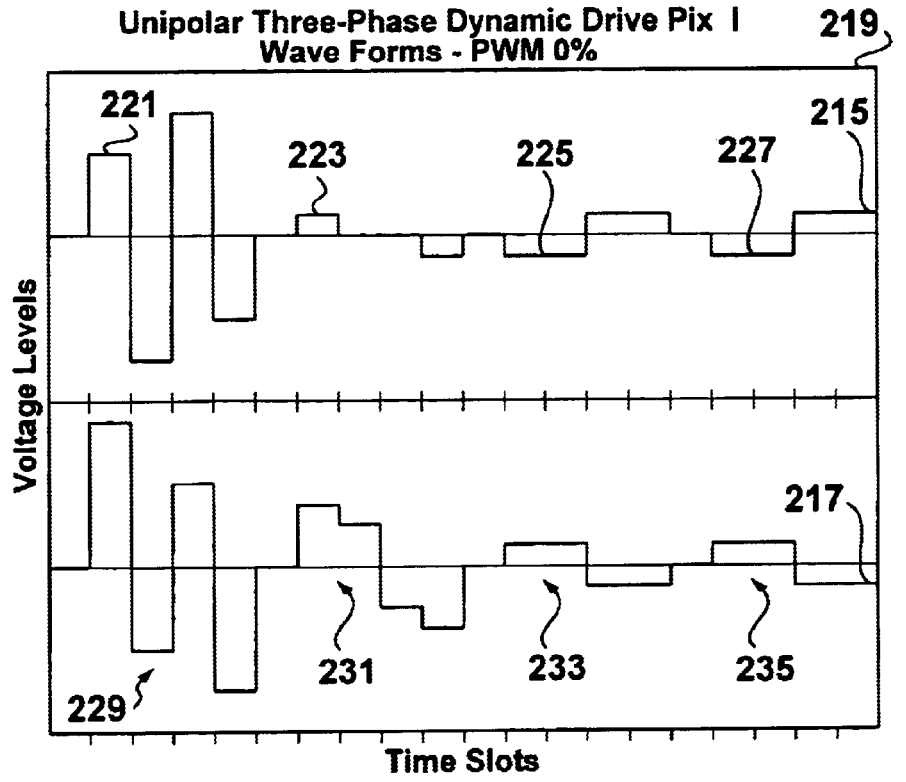
FIG. 6 illustrates a drive scheme for a cholesteric display using 0% PWM in accordance with an exemplary embodiment of the present invention.
Figure 6:
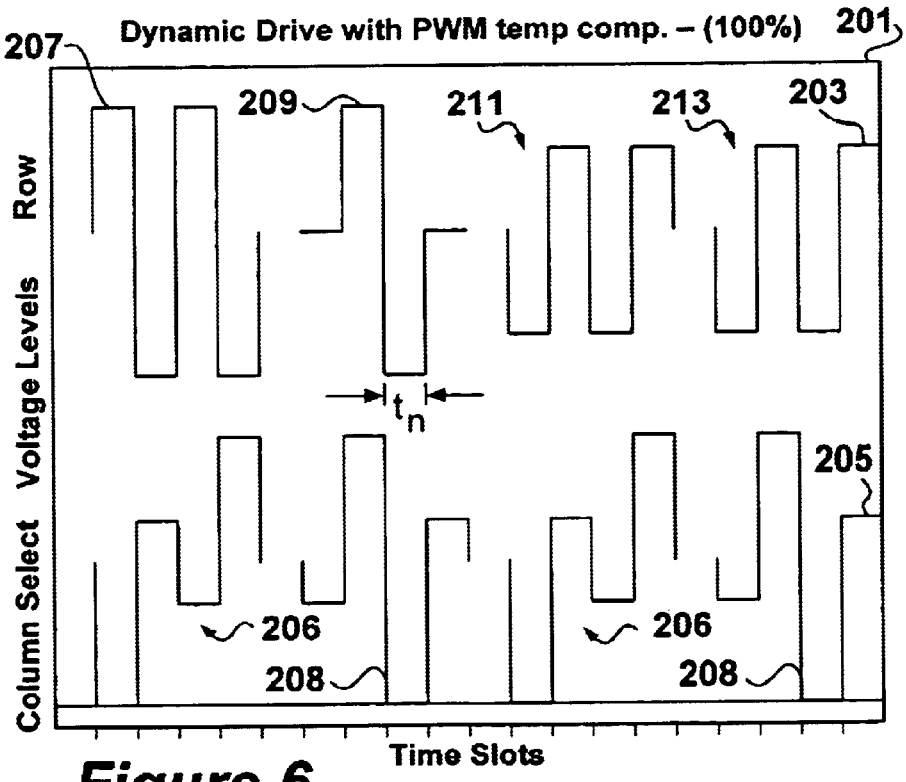

For example, the evolution phase of the common signal may be modulated using PWM. The modulated evolution phase of the common signal suitably comprises only voltage levels used in other phases, such as the preparation phase and the final phase. For example, FIGS. 3 through 6 illustrate four phases of a common signal waveform 203, unit pulses 206, 208 of a segment signal waveform 205, and the resulting select waveform 217 and deselect waveform 215 for a unipolar three-phase implementation of a dynamic drive scheme. In particular, FIG. 3 illustrates the common signal waveform 203 and resulting select and deselect waveforms 217, 215 for an evolution phase in which 100% of the PWM cycle is set at a selected voltage, such as the maximum voltage of the preparation phase portion of the common signal waveform 203, to obtain the maximum RMS voltage. FIGS. 4 through 6, on the other hand, depict versions of the common signal evolution phase modulated between the maximum voltage of the common signal preparation phase and the maximum voltage of the common signal final phase. In particular, FIG. 4 depicts an 80% PWM adjustment of the evolution phase, and FIGS. 5 and 6 illustrate common signal evolution phases for 30% PWM and 0% PWM, respectively. In FIG. 4, evolution phase 211, 225, and/or 233 is driven to the voltage level of preparation phase 207, 221, and/or 229 for 80% of the cycle and the voltage level of final phase 213, 227, and/or 235 for the remaining 20%. In FIG. 5, 30% of the cycle is driven to the voltage level of preparation phase 207, 221, and/or 229 and 70% to the voltage level of final phase 213, 227, and/or 235. FIG. 6 illustrates 0% of the cycle at the preparation phase voltage level 207, 221, and/or 229 and 100% of the cycle at the final phase voltage level 213, 227, and/or 235. In the exemplary embodiment of FIG. 6, the liquid crystal receives an RMS voltage during the evolution phase that is substantially equal to the RMS voltage during the final phase. Thus, depending on the percentage of PWM selected, an RMS voltage between the RMS voltages of the preparation phase and the final phase may be adjusted.

The drive scheme of FIGS. 3, 4, 5, and 6 are merely waveforms that may be applied according to various aspects of the present invention. Any number of combinations of voltage levels and pulse widths may be used to obtain a desired RMS voltage to drive the cholesteric display. In addition, although the various examples and exemplary embodiments illustrate using PWM during the evolution phase, PWM may be used during any phase. Also, although the various examples and exemplary embodiments illustrate using PWM for 100%, 80%, 30%, and 0%, any other combination of PWM and/or voltage levels may be used depending on the needs of the display system. Thus, any percentage of PWM may be selected, and the RMS voltage level of any phase may be used.

In the present embodiment, the drive system applies PWM adjustments to select a voltage level of evolution phase 211, 225, and/or 233 during a fraction or portion of time slot tn at the maximum voltage level of preparation phase 207, 221, and/or 229. The voltage level of final phase 213, 227, and/or 235, respectively, is applied during the remainder of time slot $t_n$. Since the RMS voltage is controlled by PWM during evolution phase 211, 225, and/or 233 by using the respective voltage levels of preparation phase 207, 221, and/or 229 and final phase 213, 227, and/or 235, two of the voltage levels of each of evolution phase 211, 225, and/or 233 may be set substantially equal to the maximum (e.g., the preparation phase) and minimum (e.g., the final phase) voltage levels of the unipolar dynamic drive scheme.

By utilizing the already available maximum (e.g., preparation phase 207) and minimum (e.g., final phase 213) voltage levels of the unipolar dynamic drive scheme, the overall number of voltage levels used for driving the cholesteric display can be reduced. As such, in this exemplary embodiment, two individual voltage levels for each of evolution phase 211, 225, and/or 233 may be eliminated. In addition, in this exemplary embodiment, the number of voltage levels, and therefore the number of voltage supplies needed to drive the cholesteric display, are reduced by two. Accordingly, the present invention may facilitate adjustment of the RMS voltage during one or more of the preparation phase, the selection phase, the evolution phase, and/or the final phase without additional voltage levels for one or more of the preparation phase, the selection phase, the evolution phase, and/or the final phase.

In addition to decreasing the number of required voltage levels, various aspects of the present invention may be applied to compensate for display variations or achieve selected display results, such as to provide temperature compensation. As discussed above, if adjustment of the RMS voltage is desired due to temperature changes, the drive system may compensate for optical effects by adjusting the RMS voltage based on the measured temperature. Thus, a drive system and method according to various aspects of the present invention allows for compensation for temperature dependent parameters (e.g., changing drive voltage requirements of the liquid crystal as a function of temperature) without changing one or more of the voltage levels of drive scheme 201.

Figure 7:
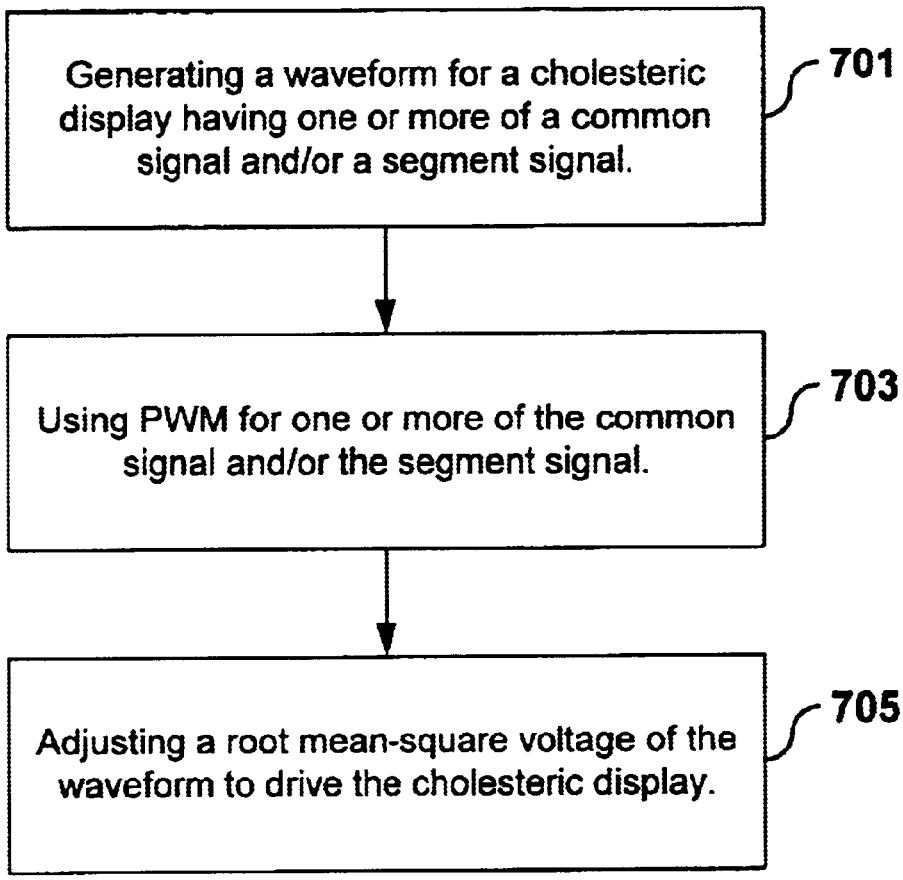
FIG. 7 illustrates a drive scheme method for a cholesteric display in accordance with an exemplary embodiment of the present invention.

Referring to FIG. 7, a method for providing a drive scheme for a cholesteric display in accordance with an exemplary embodiment of the present invention includes generating a waveform (e.g., waveform 203, waveform 205, dynamic drive waveform 215 and/or dynamic drive waveform 217) for a cholesteric display (e.g., LCD system 601 and/or cholesteric display panel 603) having one or more of a common signal and/or segment signal (step 701). One or more of the common signal or the segment signal may include one or more of a preparation phase, a selection phase, an evolution phase, and/or a final phase. The method also includes using pulse width modulation for one or more common signals and/or segment signals (step 703). Accordingly, pulse width modulation may be used for one or more of the preparation phase, the selection phase, the evolution phase, and/or the final phase. The method further includes adjusting a root-mean-square voltage of the waveform (e.g., waveform 203, waveform 205, dynamic drive waveform 215 and/or dynamic drive waveform 217) to drive the cholesteric display (step 705).

Thus, the present invention provides methods and apparatus for driving a display using fewer voltage supplies (e.g., voltage levels). In addition, the RMS voltage across any pixel during any phase may be adjusted to compensate for variables such as temperature. Further, the RMS voltage across any pixel during any phase may be adjusted to achieve a gray scale. In the present invention, PWM facilitates adjustment of the RMS voltage during any phase of the drive scheme without changing the voltage levels of the waveform used for the drive scheme. PWM adjusts the RMS voltages between a substantial maximum and a substantial minimum voltage level of the drive scheme, such as the voltage levels of the preparation phase and the final phase.

Although the invention has been described herein with reference to the drawing figures, the scope of the invention is not so limited. Various modifications in the design and implementation of various components and method steps discussed herein may be made without departing from the spirit and scope of the invention, as set forth in the appended claims. It should be understood that the exemplary methods/processes illustrated may include more or less steps or may be performed in the context of a larger processing scheme. Furthermore, the various flowcharts presented in the drawing figures are not to be construed as limiting the order in which the individual process steps may be performed. Steps recited in any method claims may be executed in any order. No element described herein is necessary for the practice of the invention, unless the element is expressly described herein as essential or required.

What is claimed is:

1. A display system, comprising:

a display panel of a plurality of pixels and having a plurality of row electrodes and a plurality of column electrodes, and a bistable chiral nematic liquid crystal material disposed between the pluralities of row and column electrodes;

a drive circuit coupled to the display panel for providing common signals to the plurality of row electrodes and segment signals to the plurality of column electrodes, wherein the common signals are applied to one or more of the plurality of row electrodes while the segment signals are applied to the plurality of column electrodes for selecting a desired state of a one or more of the plurality of pixels;

the drive circuit generates a waveform for the common signals or the segment signals that includes at least one of a preparation phase, a selection phase, an evolution phase and a final phase, wherein the waveform comprises a maximum voltage level and a minimum voltage level;

the drive circuit uses pulse width modulation to produce a root-mean-square voltage of the waveform, wherein the root-mean-square voltage of the waveform produces a voltage level that is applied to at least one of the preparation, selection, evolution and final phases;

the voltage level of at least one of the preparation phase, the selection phase, the evolution phase or the final phase is selected during a first portion of a time slot of the waveform to include the preparation phase; and the voltage level of at least one of the preparation phase, the selection phase, the evolution phase or the final phase is selected during a second portion of the time slot of the waveform to include the final phase.

2. A display system according to claim 1, wherein the waveform is unipolar.

3. A display system according to claim 1, wherein the root-mean-square voltage of the waveform produces the voltage level dynamically.

4. A display system according to claim 1, wherein the bistable chiral nematic liquid crystal material is cholesteric liquid crystal material.

5. A display system according to claim 1, further comprising a temperature sensor coupled to the display panel and connected to the drive circuit, wherein the drive circuit adjusts the pulse width modulation according to a temperature signal received from the temperature signal.

6. A display system according to claim 1, wherein the drive circuit adjusts the pulse width modulation according to a variable condition of the display panel.

7. A display system according to claim 6, wherein the variable condition is the temperature of the display panel.

* * * * *